US006100640A

United States Patent [19]

Cathey et al.

[11] Patent Number: 6,100,640

[45] Date of Patent: Aug. 8, 2000

[54] INDIRECT ACTIVATION OF A GETTER WIRE IN A HERMETICALLY SEALED FIELD EMISSION DISPLAY

[75] Inventors: David A. Cathey, Boise; Danny Dynka, Meridian, both of Id.

[73] Assignee: Micron Technology, Inc., Boise, Id.

[21] Appl. No.: 09/082,354

[22] Filed: May 20, 1998

Related U.S. Application Data

[63] Continuation-in-part of application No. 08/645,059, May 13, 1996, Pat. No. 5,827,102.

[51] Int. Cl.[7] ..... G09G 3/10

[52] U.S. Cl. ..... 315/169.3; 315/338; 445/41; 445/44; 445/50

[58] Field of Search ..... 315/169.3, 169.1, 315/338; 313/495, 309, 351; 445/24, 25, 40–44, 50–57

[56] References Cited

U.S. PATENT DOCUMENTS

| | | | |
|---|---|---|---|
| 3,665,241 | 5/1972 | Spindt | 313/351 |
| 3,755,704 | 8/1973 | Spindt et al. | 313/309 |
| 3,812,559 | 5/1974 | Spindt et al. | 29/25.18 |
| 4,156,159 | 5/1979 | Takagi | 313/155 |
| 4,743,797 | 5/1988 | Emberson et al. | 313/422 |
| 4,806,838 | 2/1989 | Weber | 318/729 |
| 4,925,741 | 5/1990 | Wong | 428/661 |
| 4,940,365 | 7/1990 | Rozanc | 405/261 |
| 5,064,396 | 11/1991 | Spindt | 445/50 |
| 5,111,049 | 5/1992 | Romano et al. | 250/352 |
| 5,210,472 | 5/1993 | Casper et al. | 315/349 |
| 5,223,766 | 6/1993 | Nakayama et al. | 313/495 |
| 5,386,432 | 1/1995 | Ficalora et al. | 372/94 |
| 5,827,102 | 10/1998 | Watkins et al. | 445/25 |

OTHER PUBLICATIONS

Borghi, M., Dr., ST 121 and ST 122 Porous Coating Getters, New Edition Nov. 19, 1992, Original Jul. 1987, pp. 2–13.

Getters Corporation of America, KEMET Getter Engineering Bulletin, "Tantalum–Titanium Alloy".

SAES Getters, ST 707 Non–Evaporable Getters Activatable at Low Temperatures.

*Primary Examiner*—Haissa Philogene
*Attorney, Agent, or Firm*—Hale and Dorr LLP

[57] ABSTRACT

A getter wire formed in a closed configuration in a vacuum sealed package is inductively heated until it evaporates, thereby forming a thin film on the inner walls of the package to getter gas molecules within the sealed package.

16 Claims, 2 Drawing Sheets

INDIRECT ACTIVATION OF A GETTER WIRE IN A HERMETICALLY SEALED FIELD EMISSION DISPLAY

REFERENCE TO RELATED APPLICATION

This application is a continuation-in-part of U.S. patent application Ser. No. 08/645,059, filed May 3, 1996, now U.S. Pat. No. 5,827,102, entitled "Low Temperature Method for Evacuating and Sealing Field Emission Displays.

STATEMENT OF GOVERNMENT RIGHTS

This invention was made with Government support under Contract No. DABT63-93-C-0025 awarded by the Advance Research Projects Agency (ARPA). The Government may have certain rights in this invention.

BACKGROUND OF THE INVENTION

A field emission display (FED) has a cathode with a matrix addressable array of thin film, cold field emitters and a phosphor-coated anode formed on a faceplate. The cathode may be formed as part of a backplate or it may be spaced from a separate backplate. The cathode emitters bombard the anode with electrons to provide a light image that can be viewed.

The backplate and faceplate are sealed in a package so that there is a very small space between the faceplate and the cathode. The package has a high vacuum to assure that the space between the anode and cathode is substantially devoid of material that could cause shorting. Contamination by residual gases, such as oxygen molecules, can adversely affect the performance of the display, and can even cause destruction.

In To prevent such destruction, a getter can be provided in the package to react with molecules generated during operation, thus preventing them from causing voltage breakdown within the device. While the getter thus addresses this problem, its placement within the FED is itself problematic. A getter can be placed to the side of the cathode, but such placement can increase the width of the display. The getter can be placed between the cathode and faceplate, but such placement may limit the resolution of the display.

After the getter is sealed in the package, it is activated. With a getter formed from an evaporable wire (as opposed to a non-evaporable powder), activation is typically performed by passing a current through the wire to heat it sufficiently to cause molecules to evaporate. To provide the current, the wire getter is coupled to electrical leads through the package seal to a power source. Passing electrical leads through the seal and heating of the leads while electrical current is being passed through, however, increases the likelihood that the seal's integrity will be compromised.

SUMMARY OF THE INVENTION

The present invention includes a field emission display (FED), and a method and apparatus for activating a getter within a sealed FED package without adversely affecting the vacuum seal therein. The getter, preferably a titanium/tantalum wire in a closed configuration, is placed within the FED package before sealing. After the package has been vacuum sealed the getter wire is exposed to non-conductive heating, such as with RF or microwave energy, to heat the getter wire to cause molecules therefrom to evaporate and form a thin film on inner walls of the package.

The present invention avoids the need for running a set of electrical leads through a package seal to heat a getter, and thus prevent such a risk to the integrity of the seal. Other features and advantages will become apparent from the following detailed description, drawings, and claims.

DETAILED DESCRIPTION

Figure 1:
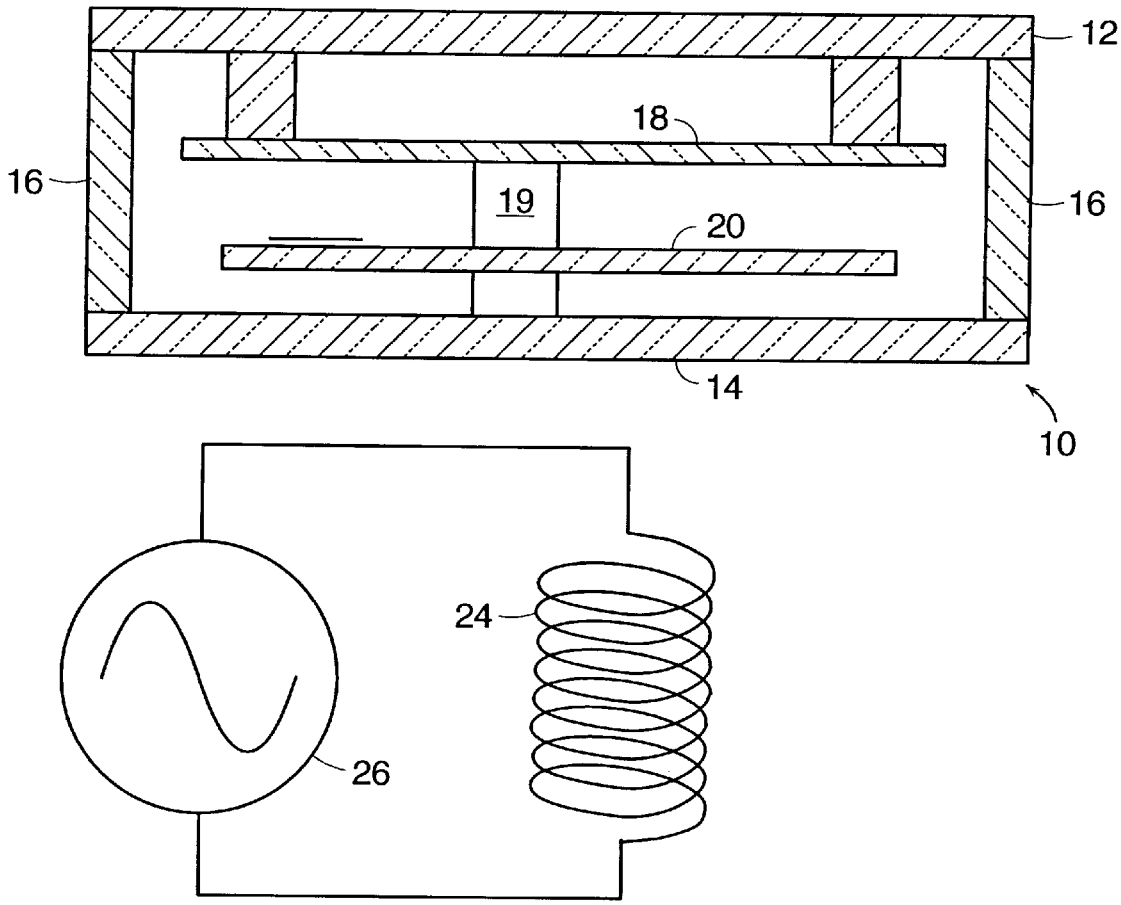
FIG. 1 is a part side view, part cross-sectional view of an FED package according to an embodiment of the present invention.
Figure 2:
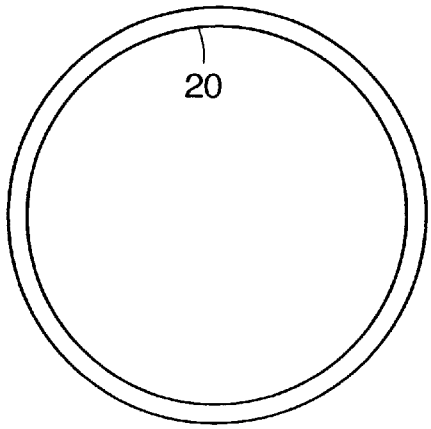
FIG. 2 a plan view of a wire configured as a ring.
Figure 4:
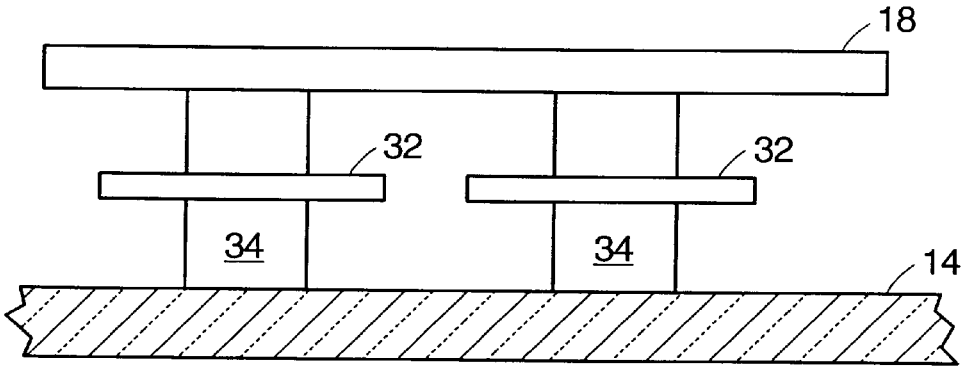

Referring to FIG. 1, a field emission display (FED) package 10 has a backplate 14, a faceplate (anode) 12, and side walls 16. FED package 10 contains a cathode 18 that has a substrate, conductive layers over the substrate, and a large plurality of emitter tips over the conductive layers. Such a cathode structure is generally known in the FED field. Cathode 18 and backplate 14 have one or more pedestal supports 19 between them. Between cathode 18 and backplate 14, a getter wire 20 is enclosed within FED package 10 prior to sealing. Getter 20 is preferably an evaporable wire formed into a closed configuration, such as a ring as shown in FIG. 2, or a coil with the ends coupled together (FIG. 4).

After package 10 is assembled and sealed, an antenna 24 (represented here as an inductor) is coupled to an RF or microwave source 26 and is positioned near FED package 10. Antenna 24 is energized to inductively heat getter 20 to a sufficient temperature to activate the getter so that the titanium evaporates and forms a thin film on inner surfaces of FED package 10.

The getter is preferably a titanium/tantalum alloy wire having a diameter of approximately 0.010 inches. The induced electrical current is sufficient to heat the tantalum so that it assists in evaporating the titanium. An example of a suitable wire is produced by Getters Corporation of America and is a metal alloy of 75% tantalum and 25% titanium. The use of such an alloy, rather than a mechanical mixture of the two elements, produces a controlled vaporized film of titanium that can be deposited in predictable amounts in limited physical areas.

Figure 3:
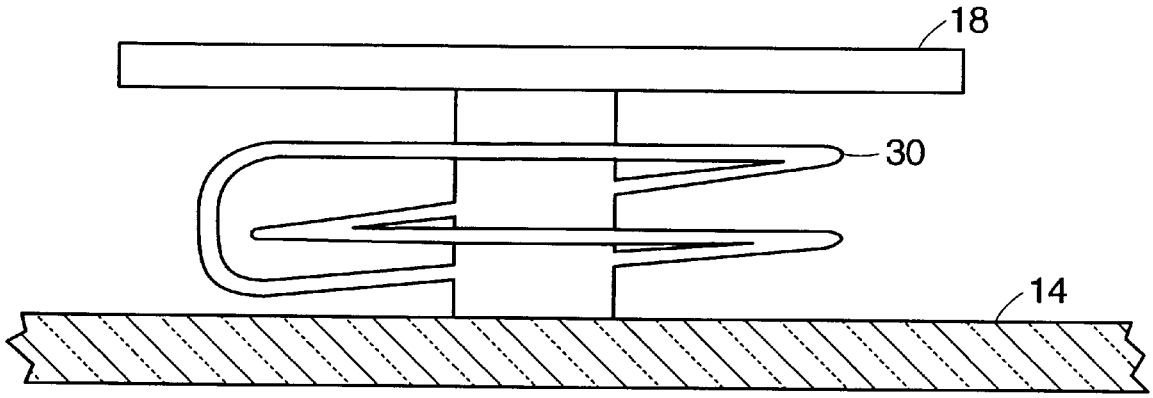
FIGS. 3 and 4 are side views of other embodiments of the present invention.

Having described a preferred embodiment, it should be apparent that modifications and changes can be made without departing from the scope of the invention as defined by the appended claims. While this invention has been described with microwave or RF heating causing the non-conductive heating, a getter wire could be heated without conduction with a laser. Referring to FIG. 3, while the getter shown in FIG. 2 is configured as a wire ring, other closed geometric configurations, such as a coil, could also be suitable. Referring to FIG. 4, in package 10 of FIG. 1, there can be multiple pedestals 34 between cathode 18 and backplate 14. In this case, rings 32 (or coils or other closed configurations) can be positioned around a number of different pedestals 34.

What is claimed is:

1. A method for gettering gas atoms within a vacuum sealed field emission display (FED) package, the method comprising the steps of:

providing a getter wire in a closed configuration between a cathode and a backplate;

assembling together a faceplate, the backplate, and sidewalls together to form a vacuum-sealed package enclosing the cathode and the getter wire; and non-conductively heating the getter wire so that the getter is activated without physically contacting the getter.

2. The method of claim 1, wherein the heating step includes heating the getter wire until atoms from the wire evaporate to form a film on inner surfaces of the sealed package.

3. The method of claim 1, wherein the closed configuration is a ring.

4. The method of claim 1 wherein the closed configuration is a coil.

5. The method of claim 1, wherein the getter wire is a titanium/tantalum alloy.

6. The method of claim 1, wherein the heating step includes energizing an RF generator.

7. The method of claim 1, wherein the heating step includes energizing a microwave generator.

8. The method of claim 1, wherein the heating step includes directing a laser at the getter wire.

9. The method of claim 1, wherein the providing step includes providing multiple getter wires, each with a closed configuration, between the cathode and backplate.

10. A field emission display (FED) package comprising:

a cathode;

a faceplate parallel to the cathode;

a backplate parallel to the faceplate and the cathode;

sidewalls connected to the faceplate and the backplate, the sidewalls, backplate, and faceplate assembled together to form a vacuum sealed package; and a getter configured as a wire in a closed configuration and enclosed in the package between the cathode and the backplate.

11. The FED of claim 10, wherein the getter wire is made of a titanium/tantalum alloy.

12. The FED of claim 10, further comprising a pedestal between the cathode and the backplate, wherein the getter wire surrounds the pedestal.

13. The FED of claim 12, further comprising a second pedestal between the cathode and the backplate, further comprising another getter wire surrounding the second pedestal.

14. The FED of claim 10, wherein the closed configuration is a ring.

15. The FED of claim 10, wherein the closed configuration is a coil.

16. A method for activating a getter comprising the steps of:

placing a getter wire with a closed configuration inside a package of a field emission display;

vacuum sealing the package;

placing a non-conductive heating source near the package; and energizing the heating source to activate the getter wire without conduction and without physically contacting the wire.

* * * * *